United States Patent [19]

Hwang

[11] Patent Number: 5,011,631

[45] Date of Patent: Apr. 30, 1991

[54] TURBO-JET AERATOR

[76] Inventor: Sean Hwang, Lung An No. 11, Chungho Tsun, Hsinshe Hsiang, Taichung Hsien, Taiwan

[21] Appl. No.: 436,292

[22] Filed: Nov. 14, 1989

[51] Int. Cl.[5] ..... B01F 3/04

[52] U.S. Cl. ..... 261/30; 261/87; 415/120

[58] Field of Search ..... 261/87, 30; 415/55.1, 415/120

[56] References Cited

U.S. PATENT DOCUMENTS

| | | | |
|---|---|---|---|
| 616,997 | 1/1899 | Whitney | 261/87 |
| 1,177,989 | 4/1916 | Bullock | 415/120 |
| 1,374,446 | 4/1921 | Greenawalt | 261/87 |
| 1,445,935 | 2/1923 | Daman et al. | 261/87 |
| 2,098,474 | 11/1937 | Tucker | 415/120 |
| 2,952,448 | 9/1960 | Cornell | 415/120 |
| 3,402,669 | 9/1968 | Mamo | 415/120 |
| 4,308,221 | 12/1981 | Durda | 261/87 |
| 4,844,843 | 7/1989 | Rajendren | 261/87 |
| 4,909,936 | 3/1990 | Arbisi | 261/87 |

*Primary Examiner*—Tim Miles

*Attorney, Agent, or Firm*—Morton J. Rosenberg; David I. Klein

[57] ABSTRACT

This invention relates to a turbo-jet aerator and in particular to one mainly including a motor, a turbo-jet means and a stirring mechanism by means of which when the motor is turned on, the turbine and the stirring mechanism will be rotated and air in the recesses between leaves of the turbine will be sucked in from the outside and ejected out through the outlet of the turbo-jet means and then the air will pass and dissolve into water of a pond.

1 Claim, 3 Drawing Sheets

TURBO-JET AERATOR

BACKGROUND OF THE INVENTION

It is found that the conventional aerator simply utilizes a motor to stir the water surface in order to dissolve air into the water. However, as for large ponds or ponds with high water flowing speed, a large motor should be used thereby wasting much energy.

Hence, it is an object of the present invention to provide a more efficient aerator which may obviate and mitigate the above-mentioned drawbacks.

SUMMARY OF THE INVENTION

This invention relates to a turbo-jet aerator for helping dissolve air into a pond of water.

It is the primary object of the present invention to provide a turbo-jet aerator which may effectively help dissolve air into a pond of water.

It is another object of the present invention to provide a turbo-jet aerator which is simple in construction.

It is still another object of the present invention to provide a turbo-jet aerator which is easy to operate.

It is a further object of the present invention to provide a turbo-jet aerator which may increase working efficacy.

Other objects and merits and a fuller understanding of the present invention will be obtained by those having ordinary skill in the art when the following detailed description of the present invention is read in conjunction with the accompanying drawings wherein like numerals refer to like or similar parts.

DETAILED DESCRIPTION OF THE PREFERRED EMBODIMENT

Figure 1:
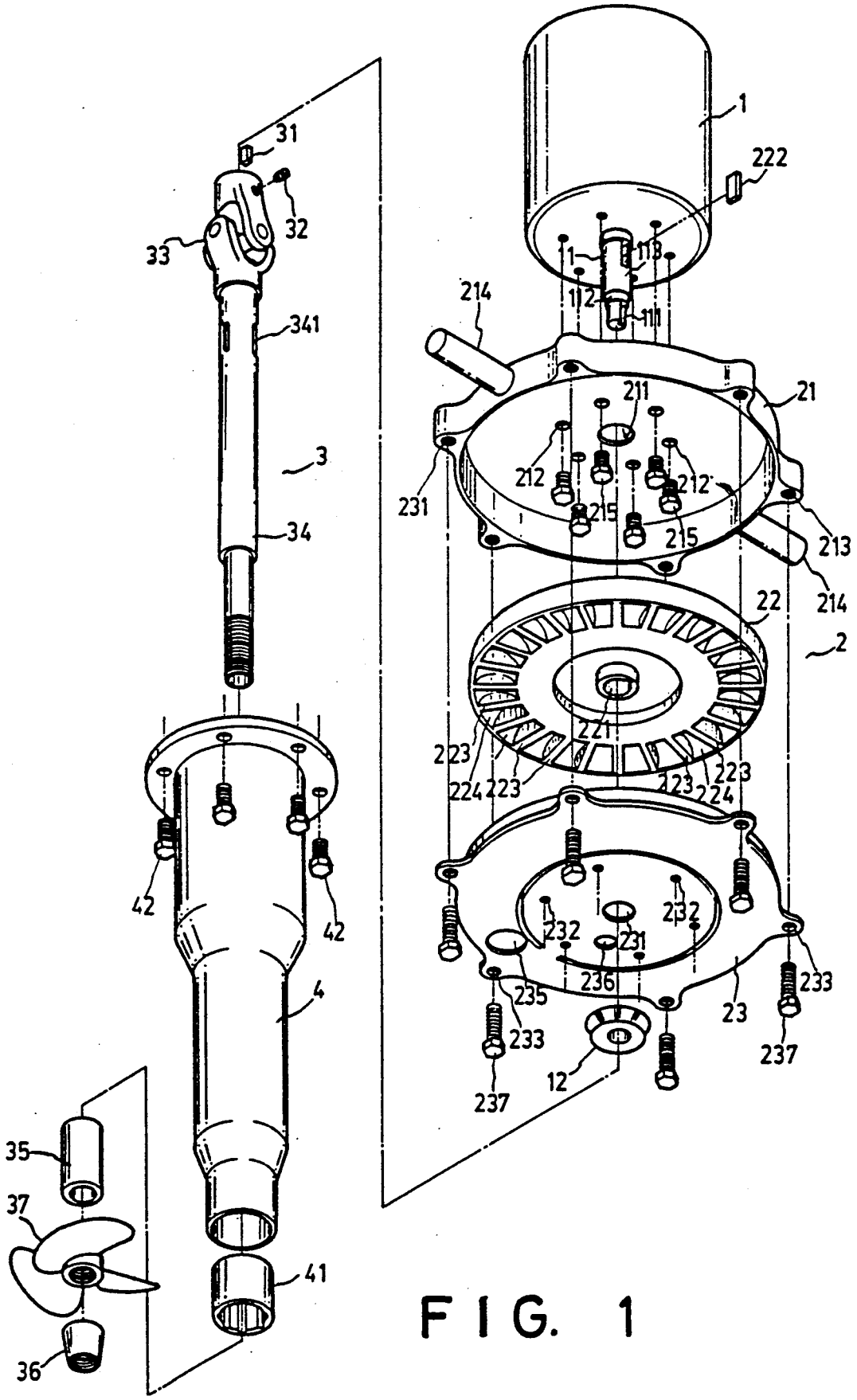
FIG. 1 is an exploded view of a turbo-jet aerator according to the present invention.
Figure 3:
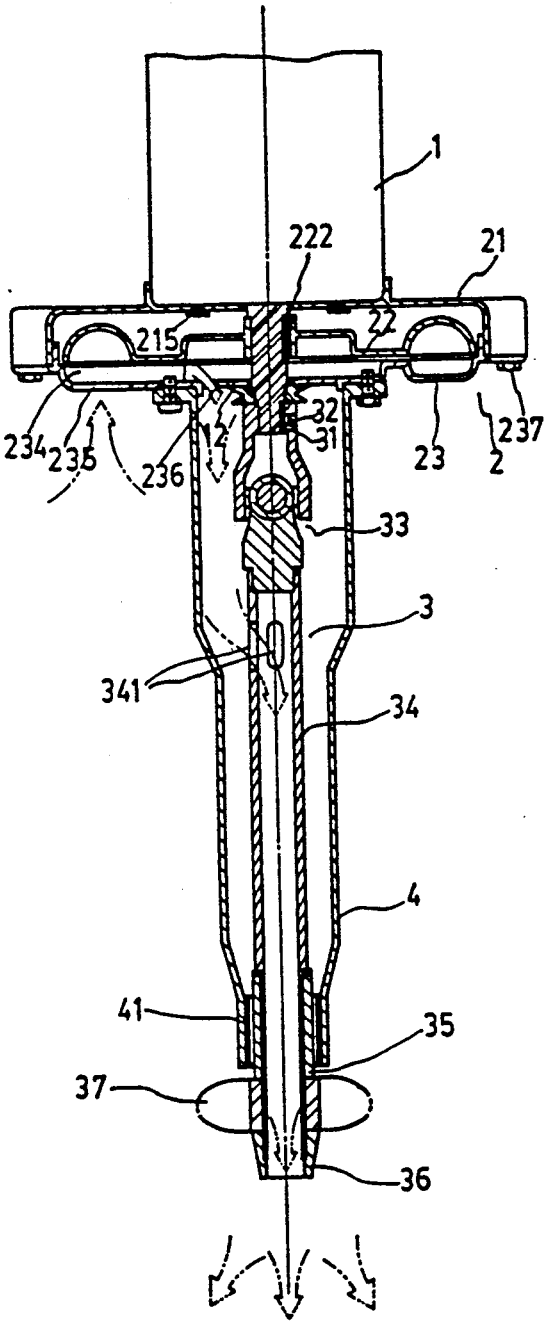
FIG. 3 is a sectional view of the turbo-jet aerator according to the present invention.
Figure 2:
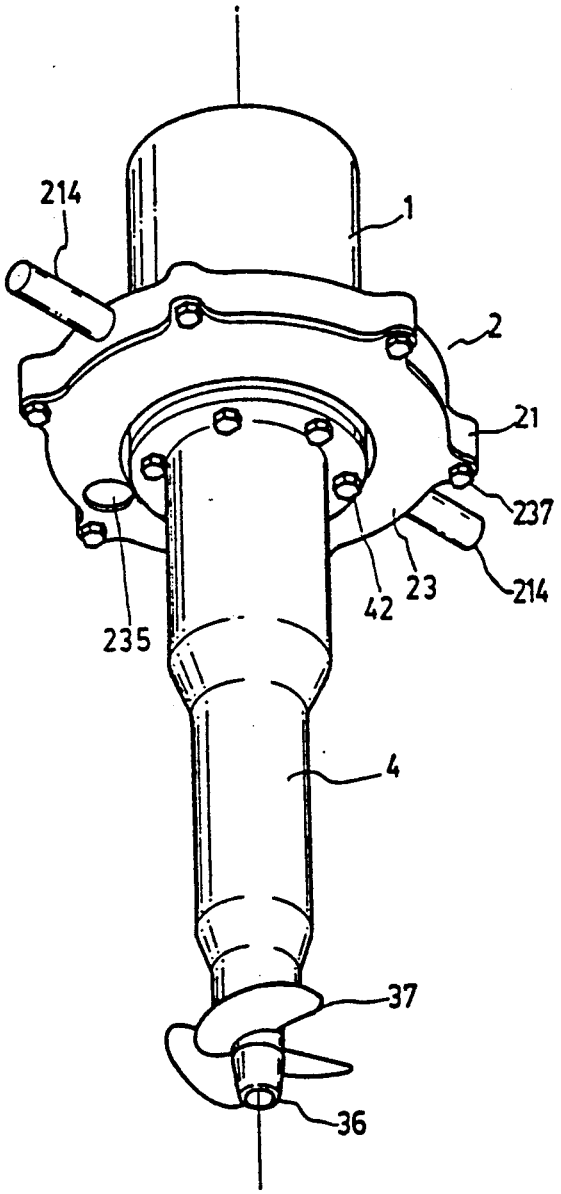
FIG. 2 is a perspective view of the turbo-jet aerator according to the present invention.
Figure 4:
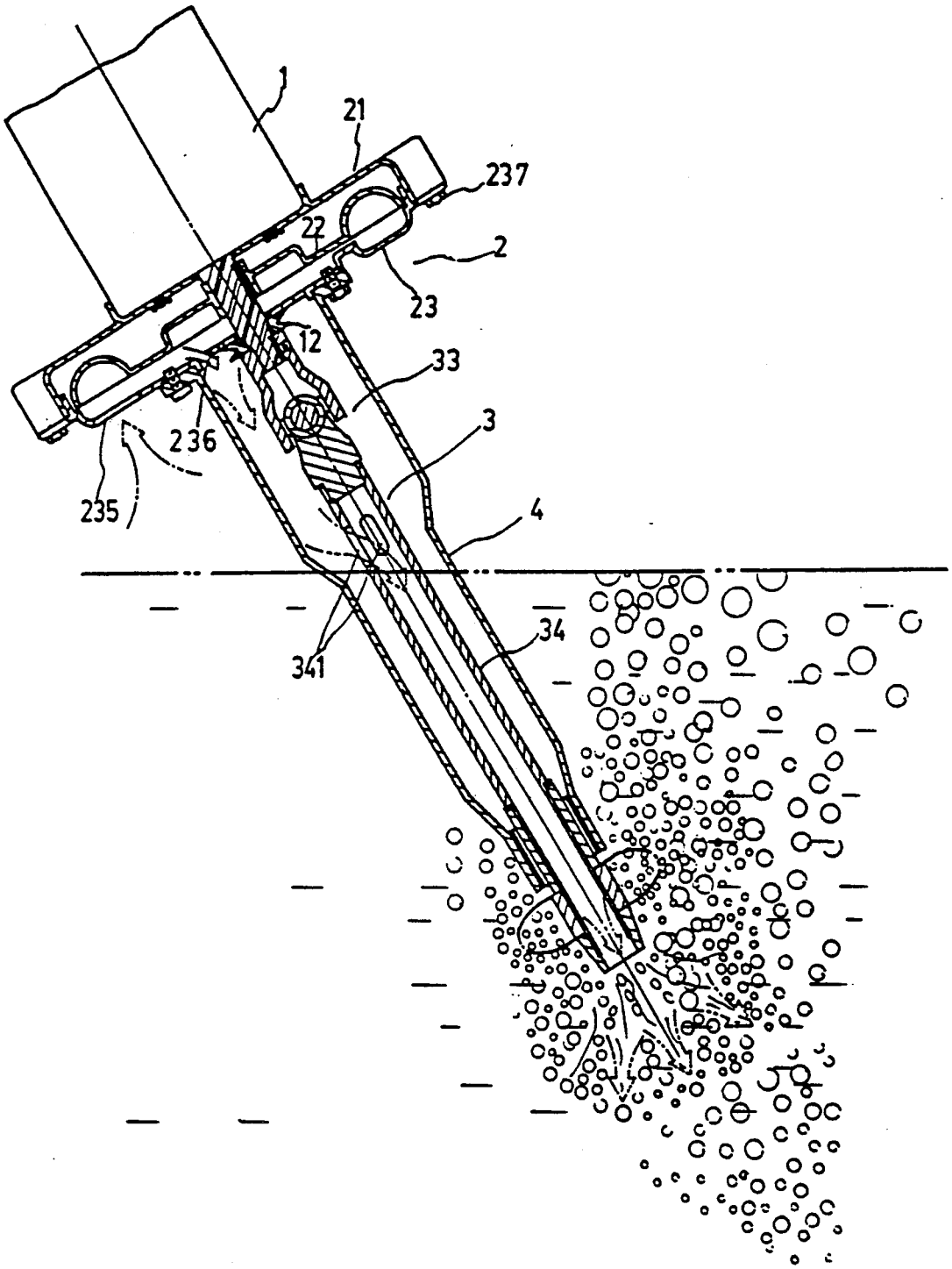
FIG. 4 is a sectional view showing an application of turbo-jet aerator according to the present invention.

With reference to the drawings and in particular to FIG. 1 thereof, the turbo-jet aerator according to the present invention mainly comprises a motor 1, a turbo-jet means 2, a stirring mechanism 3, and a casing 4. As shown in FIG. 2, the turbo-jet means 2 comprises an upper cover 21, a turbine 22 and a lower cover 23. The stirring mechanism 3 includes a key 31, a countersunk screw 32, a universal joint 33, a tubular shaft 34, a sleeve 35, a diffuser 36 and a fan 37. The upper cover 21 is a circular member with a center hole 211 and a plurality of threaded holes 212 and 213 respectively on the surface and the circumference. On the opposite side of the upper cover 21, there is a rod 214 for disposing the present invention in inclined position. The turbine 22 is provided with a center hole 221 which receives the third stepped portion 113 of the axle of the motor 1 and fixedly connected therewith by means of a key 222. The turbine 22 has a plurality of equidistant radial leaves 223 between every two of which there is a recess 224 for sucking air form outside. The lower cover 23 is a cylindrical member with a center hole 231, threaded holes 232 and 233 on the surface and the circumference, a sucking hole 235 and an air outlet 236 on the surface, which is engaged with the upper cover 21 by means of screws 237 extending the threaded holes 233 and 213. On the second stepped portion 112 of the axle 11 of the motor 1 there is a ring 12. The first stepped portion 111 of the axle 11 of the motor 1 is rigidly connected to the universal joint 33 via the key 31 and the countersunk screw 32 and welded at the end to the tubular shaft 34. The sleeve 4 is connected to the lower cover 23 by screws 42 extending through holes 232. A rubber bearing 41 is disposed at the lower end of the sleeve 4 for supporting a ferrule 35 on the tubular shaft 34. The end of the tubular shaft 34 is fixedly connected with the fan 37 by means of the diffuser 36.

As the power of the present invention is turned on, the axle 11 of the motor 1 will rotate the turbine 22 and the stirring mechanism 3. In the meantime, the recess 224 of the turbine 22 immediately reduces the pressure inside the turbo-jet means 2 and a large amount of air will be sucked in from the outside and ejected out through the outlet 236. Then, the air will pass through the sleeve 4 and the inlet 341 of the stirring mechanism 3 into the tubular shaft 34 and eject into a pond. The fan 37 is used to further dissolve air into the water of the pond.

Although this invention has been described with a certain degree of particularity, it is understood that the present disclosure is made by way of example only and that numerous changes in the detail of parts and the combination and arrangement of parts may be resorted to without departing from the spirit and scope of the invention as hereinafter claimed.

I claim:

1. A turbo-jet aerator comprising:

a motor;

a turbo-jet means having an upper cover, a turbine and a lower cover and connected to said motor, said upper cover being a cylindrical member with a center hole and threaded holes on the circumference and the surface, said lower cover being a cylindrical member with a center hole, threaded holes on the circumference and the surface, a sucking hole and an outlet on the surface, said turbine having a center hole and a plurality of equidistant radial leaves;

a stirring mechanism connected to said motor at one end and a fan at the other;

whereby when the motor is turned on, the turbine and the stirring mechanism will be rotated and recesses between leaves of said turbine will immediately reduce pressure inside said turbo-jet means and a large amount of air will be sucked in from the outside and ejected out through the outlet of said turbo-jet means and then the air will pass and dissolve into water of a pond.

* * * * *